United States Patent [19]

Eder

[11] Patent Number: 4,706,339

[45] Date of Patent: Nov. 17, 1987

[54] CLEANING TAPE FOR TOP ROLL ASSEMBLY

[76] Inventor: Kurt T. Eder, Alexanderstrasse 52, 7000 Stuttgart 1, Fed. Rep. of Germany

[21] Appl. No.: 905,923

[22] Filed: Sep. 10, 1986

[51] Int. Cl.[4] ..... D01H 5/60

[52] U.S. Cl. ..... 19/265

[58] Field of Search ..... 19/245, 262, 265

[56] References Cited

U.S. PATENT DOCUMENTS

| | | | |
|---|---|---|---|
| 2,951,268 | 9/1960 | West | 19/265 X |
| 4,317,261 | 3/1982 | Adamson | 19/265 |
| 4,370,781 | 2/1983 | Murao | 19/265 X |

FOREIGN PATENT DOCUMENTS

| | | | |
|---|---|---|---|
| 1092351 | 11/1960 | Fed. Rep. of Germany . | |
| 2217314 | 10/1973 | Fed. Rep. of Germany . | |
| 2257961 | 6/1974 | Fed. Rep. of Germany . | |
| 2317777 | 10/1974 | Fed. Rep. of Germany | 19/265 |
| 2422050 | 12/1974 | Fed. Rep. of Germany . | |

*Primary Examiner*—Louis K. Rimrodt

*Attorney, Agent, or Firm*—Bailey & Hardaway

[57] ABSTRACT

A spinning machine is improved by incorporating into the weighting arm of a drafting system a mounting support in the form of a spring which is incorporated into the weighting arm.

4 Claims, 3 Drawing Figures

CLEANING TAPE FOR TOP ROLL ASSEMBLY

BACKGROUND OF THE INVENTION

The invention relates to a weighting arm for drafting systems of spinning and roving frames with built-in cleaning device according to the description of claim 1.

In the different drafting systems applied today in the textile industry there are still mostly either stationary cleaning plates covering all lines of top rollers or individual cleaning rolls for the different top rollers in action. The well known disadvantage of both arrangements is the permanent accumulation of dust and fibers on the felts of plates and cleaner rolls. If not cleaned in short intervals the accumulated material detaches by itself in dust accumulations which are carried on from the stock in the roving path leading then to unevenness of the roving path and yarn or to stoppage of the frame. Especially on roving frames such stops can reduce the efficiency of the machine drastically.

New machines in Europe are currently preferably equipped with a rotating cleaning device known from German patent description DE-AS No. 1092351, in which a cleaning tape is pressed by an iron roll on the back top roller for its permanent drag. In spite of the relatively heavy iron roll the drag is interrupted when uneven deposits of dust and fibers on th cleaning tapes or around the axles of the iron roller arise. In addition to the inconveniences of uneven roving, the machine is sometimes stopped.

New machines built in the Far East have mostly a positive drive for the rotating cleaning arrangement. Such a device is described in German patent specification DE-OS No. 2422050. The disadvantages here are the relatively high installation costs and the enclosed space around the drafting units reducing facility of inspection and accessibility for the worker.

SUMMARY OF THE INVENTION

While current cleaning devices have been described above, the following invention is useable with a drafting system with a weighting arm known from German patent description DE-OS No. 2217314. The invention and its basic scope has the object to create a cleaning arrangement with cost saving features, safe operating conditions and meeting today's trends for a maximum reduction in workers interference. The invention does not have exposed parts around the weighting arm itself and thus avoids places for the deposit of dust and fibers and build-up by all other cleaners.

In addition, the apparatus is constructed in such a way that it can be easily and economically installed in existing drafting systems.

BRIEF DESCRIPTION OF THE DRAWINGS

The cleaning apparatus works with contact pressure. FIG. 1 shows a weighting arm known from German patent specification DE-OS No. 2257961 where a flat spring 4 is introduced between body of the arm 1 and back weighting element 2 and fixed there with screw 3. When opening the screw 3 both element 2 with flat spring 4 are movable longitudinally. The flat spring 4 is in the middle lower body 1 of the weighting arm and incorporates a support for the axle of tape guide roller 5 which is permanently pressed, together with tape 6, against synthetic cover 10 of top roller 11. The strength and angle of attack of flat spring 4 to top roller 11 are designed in a way that the contact pressure of cleaning tape 6 against top roller-cover 10 is strong enough after the usual grinding processes for cover 10.

Figure 1:
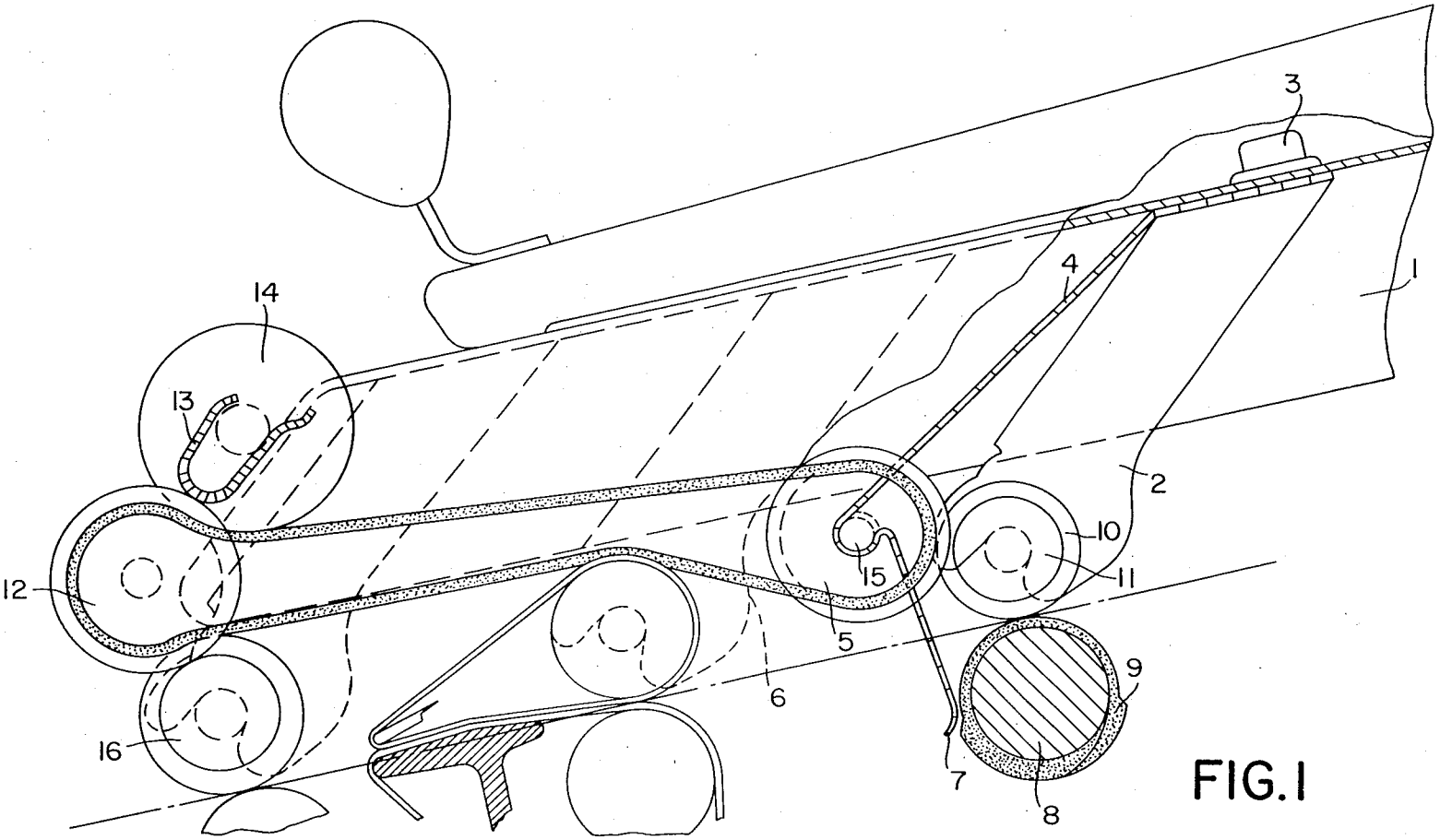
FIG. 1 is the apparatus of this invention in a weighting arm.
Figure 2:
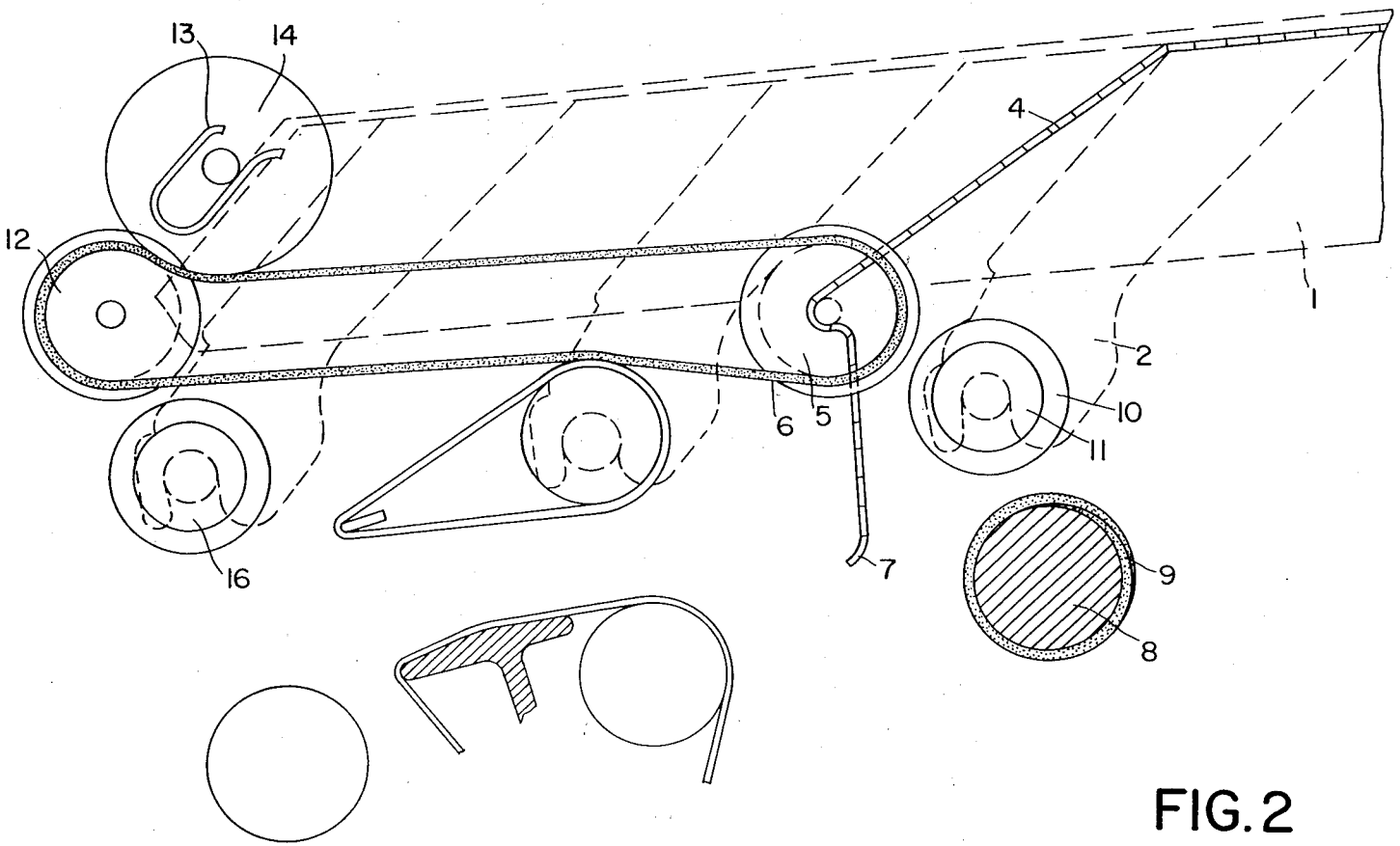
FIG. 2 is the apparatus with weighting arm opened.

Another guide roller 12 having the same construction features of guide roller 5 floats on front top roller 16 with a predetermined overhang and is forced into working position by a pivot roller 14 movable up and down in a guide spring 13 which is fixed on the front side of the weighting arm body 1. Pilot roller 14 guarantees a regular and permanent tension of cleaning tape 6.

The free pendulum guidance of tape guide roller 12—no axle support—assures at the time its proper function through self-alignment even when top roller 16 is not keeping its rectangular position to body 1 and the arm can not maintain a paraxial position to the front bottom roller.

Figure 3:
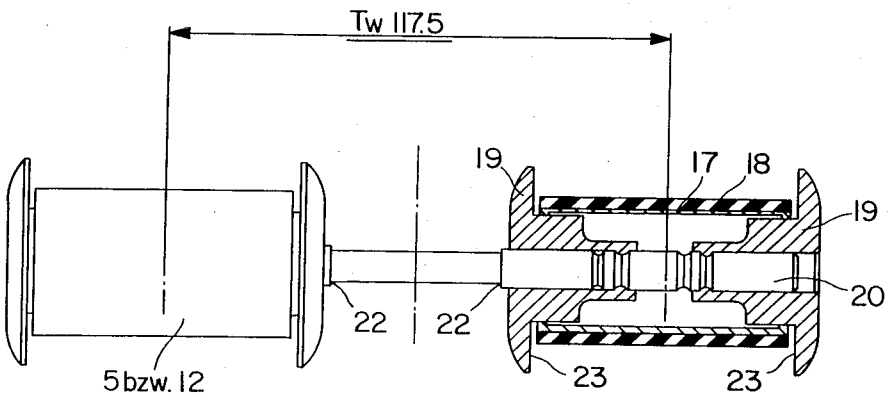
FIG. 3 is a guide roll for the cleaning tape.

The loose rolls 17 of guide roller 5 at 12, see FIG. 3, are equipped with a removable cover 18 for having the ability to work with different hardnesses in rubber or synthetic material to obtain the best possible drag for cleaning tape 6.

The guide rollers 5 and 12 are also designed as side guide rollers having on both sides two detachable side guide plates 19 which overlap back top roller 11, front top roller 16 and pilot roller 14 avoiding so the slide off of tape guide rollers 5 and 12 from top rollers 11 and 16 and keeping finally the whole unit in a safe and self-stabilizing working position.

The flat spring 4 has at the bottom end an enlarged transmitter zone 7 which stands with a small distance in front of the back bottom roller 8 between the fluted fields. When fitting in this area an eccentric 9 the device can also work in determined interrupted intervals.

It is thus seen that the invention as generally described provides significant advantages over the prior art. While various modifications will become apparent from the above description, such modifications are embodied within the scope of this invention as defined by the following claims.

Having thus described the invention, what is claimed is:

1. In a weighting arm for drafting systems of spinning machines having a built-in cleaning device with driven cleaning tapes where the tape guide rollers are fitted in an incorporated mounting support, the movement for the cleaning tapes is taken up from the top roller, the improvement, comprising:

the mounting support is incorporated in the weighting arm the mounting support is a spring (4)

the drive of the cleaning tapes (6) is taken up by contact pressure of tape guide roller (5) with its cleaning tape (6) to back top roller (11) through spring (4).

2. The improvement according to claim 1 wherein said spring (4) and an eccentric (9) around bottom roller (8) controls the pressure of spring (4) for permanent or interrupted movement of cleaning tape.

3. The improvement according to claim 1 characterized by the fact that the tape guide rollers (5 and 12) have a lateral guidance (23).

4. The improvement according to claim 1 characterized by the fact that for suspension or function of the device no fixed parts are used on both sides of the arm.

* * * * *